US008345037B2

(12) United States Patent
Guan et al.

(10) Patent No.: US 8,345,037 B2
(45) Date of Patent: Jan. 1, 2013

(54) LIQUID CRYSTAL DISPLAY DEVICE AND DRIVING METHOD THEREOF

(75) Inventors: Sai-Xin Guan, Shenzhen (CN); Fu-Cheng Yang, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 437 days.

(21) Appl. No.: 12/652,695

(22) Filed: Jan. 5, 2010

(65) Prior Publication Data

US 2010/0171772 A1 Jul. 8, 2010

(30) Foreign Application Priority Data

Jan. 6, 2009 (CN) ..... 2009 1 0300080

(51) Int. Cl.
*G09G 5/00* (2006.01)

(52) U.S. Cl. ..... 345/213; 345/87; 345/100; 345/204; 345/214

(58) Field of Classification Search ..... 345/690
See application file for complete search history.

(56) References Cited

U.S. PATENT DOCUMENTS

| | | | | |
|---|---|---|---|---|
| 2006/0050837 | A1* | 3/2006 | Jung | 377/67 |
| 2007/0291190 | A1* | 12/2007 | Shin et al. | 349/37 |
| 2008/0018564 | A1* | 1/2008 | Jung et al. | 345/68 |
| 2008/0079701 | A1* | 4/2008 | Shin et al. | 345/204 |
| 2008/0088550 | A1* | 4/2008 | Kim et al. | 345/82 |
| 2008/0122829 | A1* | 5/2008 | Park | 345/213 |
| 2008/0165104 | A1* | 7/2008 | Hashimoto | 345/88 |
| 2008/0186297 | A1* | 8/2008 | Morita | 345/211 |
| 2008/0252625 | A1* | 10/2008 | Liao et al. | 345/204 |

FOREIGN PATENT DOCUMENTS

CN 100461253 C 2/2009

* cited by examiner

*Primary Examiner* — Quan-Zhen Wang
*Assistant Examiner* — David Lee
(74) *Attorney, Agent, or Firm* — WPAT PC; Justin King

(57) ABSTRACT

A liquid crystal display (LCD) device and a driving method thereof are provided. The LCD device includes a display panel including pixel units, a data driving circuit, and a gate driving circuit. The gate driving circuit provides a first gate off voltage to one pixel unit of the pixel units when the data driving circuit provides a data voltage having a positive polarity to the pixel unit, the gate driving circuit provides a second gate off voltage to one pixel unit of the pixel units when the data driving circuit provides a data voltage having a negative polarity to the pixel unit. The second gate off voltage is less than the first gate off voltage.

18 Claims, 3 Drawing Sheets

LIQUID CRYSTAL DISPLAY DEVICE AND DRIVING METHOD THEREOF

BACKGROUND

1. Technical Field

The present disclosure generally relates to display technology, and particularly to a liquid crystal display (LCD) device and a method for driving the LCD device.

2. Description of Related Art

LCD display has advantages of low power consumption and low radiation, and has been widely used in various portable information products such as notebooks, personal digital assistants (PDAs), video cameras and the like. Conventionally, an LCD device includes a display panel. The display panel usually includes a plurality of gate lines and a plurality data lines insulated from and intersecting the plurality of gate lines. The plurality of gate lines and the plurality data lines define a plurality of pixel units. Each pixel unit includes a thin film transistor (TFT) and a liquid crystal capacitor.

When a gate on voltage is applied to a gate line, a corresponding TFT connected to the gate line is turned on, whereby a data voltage provided by a corresponding data line connected to the TFT is applied to the liquid crystal capacitor. At the same time, a common voltage is applied to the liquid crystal capacitor. When a gate off voltage is applied to the TFT via the gate line, the TFT is turned off, and a voltage difference between the data voltage and the common voltage is held by the liquid crystal capacitor. The voltage difference between the data voltage and the common voltage generates an electric field, driving liquid crystal variation. A resulting transmittance of light through the display panel provides display capability.

However, when the gate off voltage is applied to the TFT via the gate line, due to a parasitic capacitance formed between a gate electrode and a source electrode of the TFT, the TFT cannot be turned off completely, and a drain current is generated between the source electrode and a drain electrode of the TFT. Accordingly, voltage difference across the liquid crystal capacitor decreases. When the data voltage is applied with opposite polarities, a decreasing variation of the voltage difference due to the drain current being driven under a positive polarity is different from that under a negative polarity. Thereby flicker is generated, compromising quality of the display of the LCD device.

What are needed, therefore, are an LCD device and a driving method thereof which can overcome the described limitations.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Reference will now be made to the drawings to describe the disclosure in detail.

Figure 1:
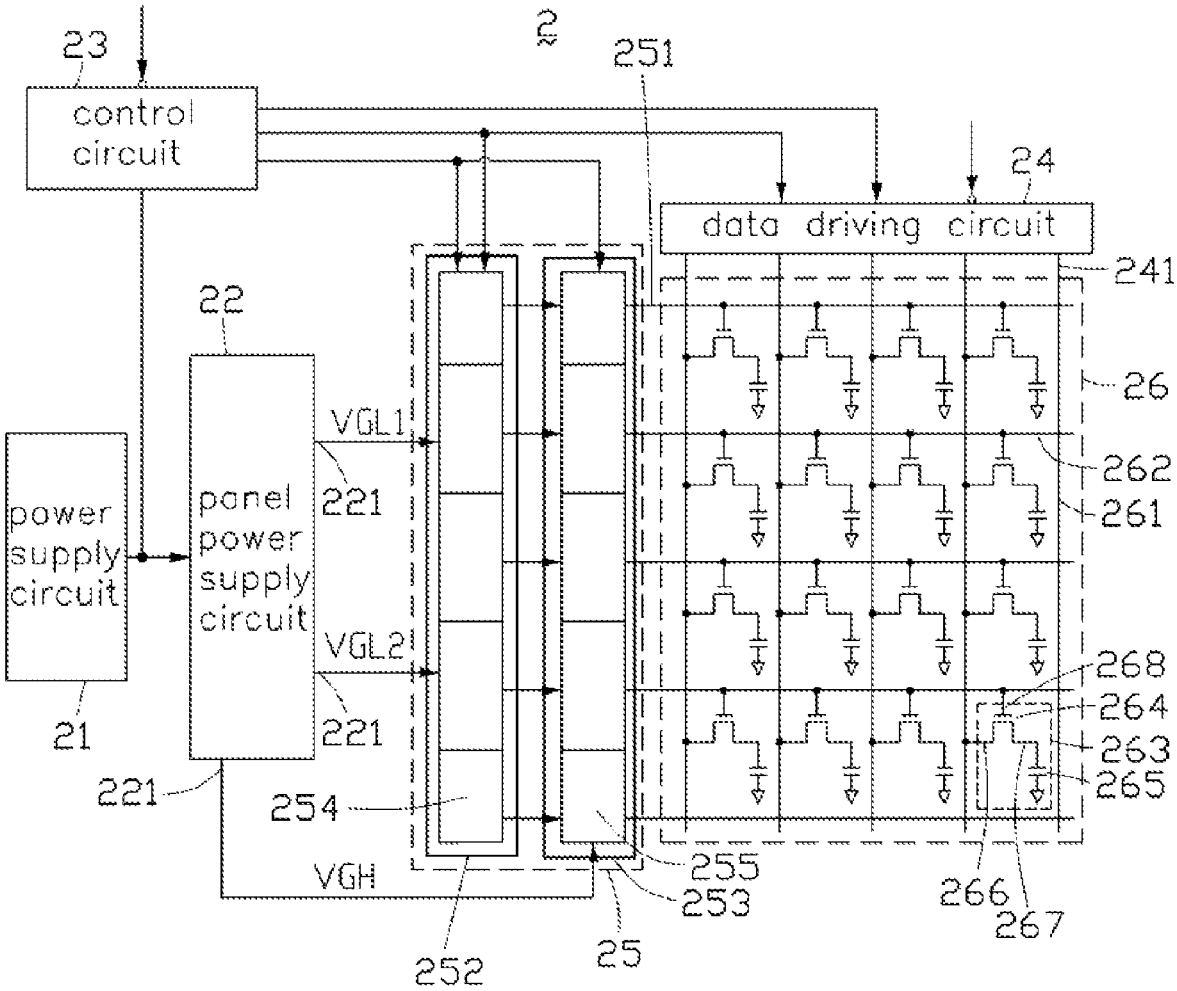
FIG. 1 is a circuit diagram of a first embodiment of an LCD device, the LCD including a plurality of pixel units.

Referring to FIG. 1, a circuit diagram of a first embodiment of an LCD device is shown. The LCD device 2 includes a power supply circuit 21, a panel power supply circuit 22, a control circuit 23, a data driving circuit 24, a gate driving circuit 25, and a display panel 26. The display panel 26 includes a plurality of data lines 261 and a plurality of gate lines 262. The data lines 261 are parallel to each other. The gate lines 262 are parallel to each other, and insulated from and intersecting the data lines 261. The data lines 261 and the gate lines 262 cooperatively define a plurality of pixel units 263. Each pixel unit 263 includes a TFT 264 and a liquid crystal capacitor 265. A source electrode 266 of the TFT 264 is coupled to a corresponding data line 261, a drain electrode 267 of the TFT 264 is coupled to the liquid crystal capacitor 265, and a gate electrode 268 is coupled to a corresponding gate line 262.

The power supply circuit 21 receives an alternating current (AC) voltage, converts it into a direct current (DC) voltage by transforming, rectifying, filtering, and stabilizing, and outputting the resulting DC voltage to the panel power supply circuit 22 and the control circuit 23.

The control circuit 23, activated by the DC voltage, processes synchronized signals output from an external circuit (not shown), and generates a clock pulse signal, a reverse control signal and a scanning signal. The clock pulse signal is output to the data driving circuit 24, the scanning signal is output to the gate driving circuit 25, and the reverse control signal is output to the data driving circuit 24 and the gate driving circuit 25.

The data driving circuit 24 includes a plurality of data output terminals 241, respectively coupled to the data lines 261. The data driving circuit 24 receives the clock pulse signal and the reverse control signal, and outputs data voltages to the display panel 26 via the data output terminals 241. In a pulse period of the clock pulse signal, the data driving circuit 24 reads a data signal from an external circuit (not shown) at a rising edge of the clock pulse signal, processes the data signal, and outputs data voltages of a processed data signal to the display panel 26. The data driving circuit 24 may output the data voltages via a frame inversion mode, a line inversion mode or a dot inversion mode according to the reverse control signal. If the frame inversion mode is used, that is, the data driving circuit 24 outputs data voltages having opposite polarities in adjacent frames. If the line inversion mode is used, that is, in a frame time, the data driving circuit 24 outputs data voltage having opposite polarities in adjacent pulse periods of the clock pulse signal. For example, when a gate line 262 is scanned in a pulse period, the data driving circuit 24 outputs data voltages having a positive polarity. When the subsequent gate line 262 is scanned in the subsequent pulse period, the data driving circuit 24 outputs data voltages having a negative polarity.

The panel power supply circuit 22 includes three voltage output terminals 221. The panel power supply circuit 22 receives the DC voltage, and converts the DC voltage to a gate on voltage VGH, a first gate off voltage VGL1, and a second gate off voltage VGL2 via a plurality of DC-DC converters (not shown). The gate on voltage VGH is a forward bias voltage for the TFT 264, with a value preferably +15.xV or +24.xV wherein x is a natural number. The first gate off voltage VGL1 and the second gate off voltage VGL2 are reverse bias voltages for the TFT 264, with a value of the first gate off voltage VGL1 preferably −10.xV or −6.xV wherein x is a natural number, and a value of the second gate off voltage VGL2 less than that of the first gate off voltage VGL1. The gate on voltage VGH, the first gate off voltage VGL1 and the second gate off voltage VGL2 are output to the gate driving circuit 25 via the three voltage output terminals 221, respectively.

The gate driving circuit 25 includes a plurality of gate signal output terminals 251 respectively coupled to the gate lines 262. The gate driving circuit 25 receives the scanning signal and the reverse control signal from the control circuit 23, and successively scans the gate lines 262. When a gate line 262 is scanned, the gate driving circuit 25 outputs the gate on voltage VGH to the gate line 262 to turn on the TFTs 264 connected to the gate line 262. After the gate line 262 is scanned, the gate driving circuit 25 outputs the first gate off voltage VGL1 or the second gate off voltage VGL2 to the gate lines 262. According to the reverse control signal, the first gate off voltage VGL1 is output to the gate lines 262 coupled to the pixel units 263 which receive the data voltage having the positive polarity, and the second gate off voltage VGL2 is output to the gate lines 262 coupled to the pixel units 263 which receive the data voltage having the negative polarity.

The gate driving circuit 25 further includes a voltage storage module 252, and a scanning module 253. The voltage storage module 252 includes a plurality of voltage storage units 254. Each voltage storage unit 254 corresponds to one of the gate lines 262. The voltage storage units 254 are sequentially scanned according to the scanning signal. If a voltage storage unit 254 is scanned, the voltage storage unit 254 stores the first gate off voltage VGL1 or the second gate off voltage VGL2. When the pixel units 263 connected to a gate line 262 corresponding to the scanned voltage storage unit 254 receive the data voltages having the positive polarity, the scanned voltage storage unit 254 stores the first gate off voltage VGL1 according to the reverse control signal, or the scanned voltage storage unit 254 stores the second gate off voltage VGL2. The scanning module 253 includes a plurality of selecting units 255. Each selecting unit 255 corresponds to one of the voltage storage units 254 and one of the gate lines 262. The scanning module 253 synchronously scans the selecting units 255 according to the scanning signal. If a selecting unit 255 is scanned, the selecting unit 255 outputs the gate on voltage VGH to a corresponding gate line 262, and after the selecting unit 255 is scanned, the selecting unit 255 outputs the first gate off voltage VGL1 or the second gate off voltage VGL2 stored in a corresponding voltage storage unit 254.

Figure 2:
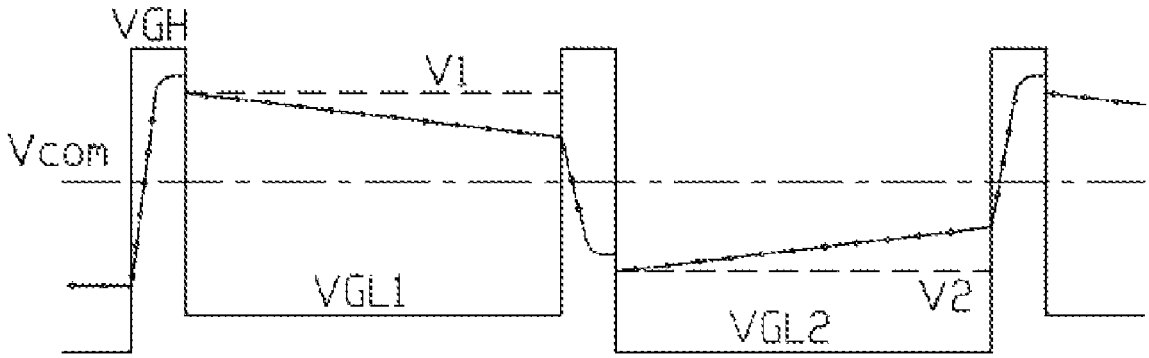
FIG. 2 is a wave diagram of driving signals of a pixel unit of FIG. 1.

Referring to FIG. 2, to drive the pixel unit 263 via the frame inversion mode, during a frame time T1, the TFT 264 of the pixel unit 263 is turned up when the gate on voltage VGH is applied to a corresponding gate line 262, a common voltage Vcom is applied to the liquid crystal capacitor 265, and a data voltage having the positive polarity V1 is applied to the liquid crystal capacitor 265, wherein V1>Vcom. After a charging time of the liquid crystal capacitor 265, the TFT 264 is turned off when the first gate off voltage VGL1 is applied to the corresponding gate line 262, and the liquid crystal capacitor 265 holds the data voltage having the positive polarity V1. During the subsequent frame time T2, the TFT 264 is turned up when the gate on voltage VGH is applied to the corresponding gate line 262 again, the common voltage Vcom is applied to the liquid crystal capacitor 265, and a data voltage having the negative polarity V2 is applied to the liquid crystal capacitor 265, wherein V2<Vcom. After the charging time of the liquid crystal capacitor 265, the TFT 264 is turned off when the second gate off voltage VGL2 is applied to the corresponding gate line 262, and the liquid crystal capacitor 265 holds the data voltage having the negative polarity V2. In this embodiment, the data voltages V1, V2 have different values corresponding to different grayscales, due to the LCD device mainly displaying a grayscale with a grayscale voltage in a range of 20%-80% of the maximal grayscale voltage. A difference between the first gate off voltage VGL1 and the second gate off voltage VGL2 is preferably in a range from about 40% of the maximal grayscale voltage to about 160% of the maximal grayscale voltage, particularly substantially equal to the maximal grayscale voltage.

In summary, corresponding to the pixel unit 263 applied with the data voltage having the positive polarity V1, the gate driving circuit 25 applies the first gate off voltage VGL1 to turn off the TFT 264 of the pixel unit 263. While corresponding to the pixel unit 263 applied with the data voltage having the negative polarity V2, the gate driving circuit 25 applies the second gate off voltage VGL2 to turn off the TFT 264. Due to the second gate off voltage VGL2 being less than the first gate off voltage VGL1, a difference between a voltage difference V1−VGL1 and a voltage difference VGL2−V2 is decreased or eliminated. For example, if the same grayscale is displayed by the pixel unit 263 during the two frame times T1 and T2, that is, V1=−V2, a decreasing variation of a voltage difference on the liquid crystal capacitor 265 due to a drain current of the TFT 264 is substantially the same in the two frame times T1 and T2. Thus, flicker is reduced or eliminated.

Figure 3:
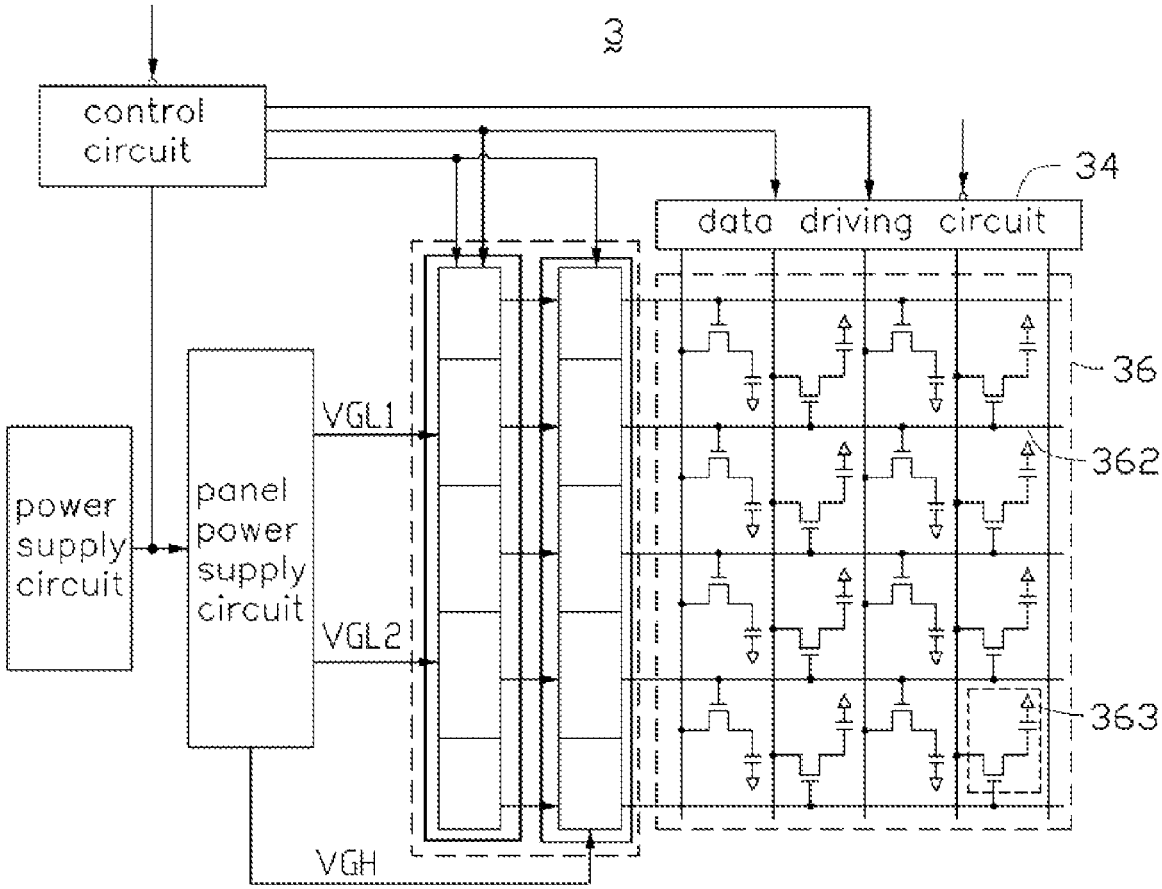
FIG. 3 is a circuit diagram of a second embodiment of an LCD device.

Referring to FIG. 3, a circuit diagram of a second embodiment of an LCD device 3 is shown, differing from LCD device 2, only in that in display panel 36, adjacent pixel units 363 along an axis of gate lines 362 are respectively coupled to two adjacent gate lines 362. In this embodiment, the data driving circuit 34 may output data voltages via a line inversion mode according to a reverse control signal. That is, in a frame time, the data voltages having opposite polarities are output in adjacent pulse periods of a clock pulse signal. However, due to the coupling mode between pixel units 363 and the gate lines 362, the display panel 36 can achieve a display of dot inversion. That is, in a frame time, each pixel unit 363 is applied with a data voltage having a polarity opposite to any adjacent pixel unit 363.

It should be pointed out that in alternative embodiments, the gate driving circuit can alternately scan the display panel.

It is believed that the present embodiments and their advantages will be understood from the foregoing description, and it will be apparent that various changes may be made thereto without departing from the spirit and scope of the embodiments or sacrificing all of their material advantages.

What is claimed is:

1. A liquid crystal display (LCD) device, comprising:

a display panel comprising a plurality of pixel units;

a data driving circuit; and a gate driving circuit;

wherein the gate driving circuit provides a first gate off voltage to one pixel unit of the plurality of pixel units after the data driving circuit provides a data voltage having a positive polarity to the pixel unit, the gate driving circuit provides a second gate off voltage to the pixel unit after the data driving circuit provides a data voltage having a negative polarity to the pixel unit, and the second gate off voltage being less than the first gate off voltage;

wherein the data voltages correspond to different grayscales, and a difference between the first gate off voltage and the second gate off voltage being from about 40% of a maximal grayscale voltage to about 160% of the maximal grayscale voltage.

2. The LCD device of claim 1, wherein the gate driving circuit comprises a voltage storage module and a scanning module, the voltage storage module comprising a plurality of voltage storage units each to store one of the first gate off voltage and the second gate off voltage, and the scanning module comprising a plurality of selecting units respectively corresponding to the plurality of voltage storage units each to output one of the first gate off voltage and the second gate off voltage.

3. The LCD device of claim 2, wherein the display panel comprises a plurality of data lines parallel to each other and a plurality of gate lines insulated from and intersecting the data lines, and the plurality of data lines and the plurality of gate lines defining the plurality of pixel units.

4. The LCD device of claim 3, wherein each of the plurality of selecting units corresponds to one of the plurality of voltage storage units and one of the plurality of gate lines, when the pixel units connected to one of the plurality of gate lines receives the data voltages having the positive polarity, a corresponding voltage storage unit stores the first gate off voltage, and a corresponding selecting unit outputs the first gate off voltage to the gate line, when the pixel units receive the data voltages having the negative polarity, the corresponding voltage storage unit stores the second gate off voltage, and the corresponding selecting unit outputs the second gate off voltage to the gate line.

5. The LCD device of claim 3, wherein adjacent pixel units along an axis of the plurality of gate lines are respectively coupled to two adjacent gate lines.

6. The LCD device of claim 2, further comprising a power supply circuit, a panel power supply circuit, and a control circuit, wherein the power supply circuit provides a direct current voltage to the panel power supply circuit and the control circuit, the control circuit provides a clock pulse signal and a reverse control signal to the data driving circuit and a scanning signal and the reverse control signal to the gate driving circuit, and the panel power supply circuit provides a gate on voltage, the first gate off voltage and the second gate off voltage to the display panel.

7. The LCD device of claim 6, wherein the plurality of voltage storage units each stores one of the first and the second gate off voltages according to the scanning signal and the reverse control signal, and the plurality of the selecting units each outputs selectively one of the gate on voltage, the first and the second gate off voltage according to the scanning signal and the reverse control signal.

8. The LCD device of claim 1, wherein the difference between the first gate off voltage and the second gate off voltage is substantially equal to the maximal grayscale voltage.

9. A method for driving a liquid crystal display (LCD) device, the LCD device comprising a display panel comprising a plurality of pixel units, a data driving circuit and a gate driving circuit, the method comprising:

providing the plurality of pixel units with data voltages having opposite polarities via the data driving circuit;

providing one pixel unit of the plurality of pixel units with a first gate off voltage via the gate driving circuit after the data driving circuit provides a data voltage having a positive polarity to the pixel unit; and providing one pixel unit of the plurality of pixel units with a second gate off voltage via the gate driving circuit after the data driving circuit provides a data voltage having a negative polarity to the pixel unit, wherein the second gate off voltage is less than the first gate off voltage;

wherein the data voltages correspond to different grayscales, and a difference between the first gate off voltage and the second gate off voltage being from about 40% of a maximal grayscale voltage to about 160% of the maximal grayscale voltage.

10. The method of claim 9, wherein the display panel comprises a plurality of data lines parallel to each other and a plurality of gate lines insulated from and intersecting the data lines, and the plurality of data lines and the plurality of gate lines defining the plurality of pixel units.

11. The method of claim 10, wherein the gate driving circuit comprises a voltage storage module and a scanning module, the voltage storage module comprising a plurality of voltage storage units respectively corresponding to the plurality of gate lines to store one of the first gate off voltage and the second gate off voltage, the scanning module comprising a plurality of selecting units respectively corresponding to the plurality of voltage storage units to output one of the first gate off voltage and the second gate off voltage, and one of the plurality of selecting units corresponds to one of the plurality of voltage storage units and one of the plurality of gate lines.

12. The method of claim 11, wherein the LCD device further comprises a power supply circuit, a panel power supply circuit, and a control circuit, the power supply circuit providing a direct current voltage to the panel power supply circuit and the control circuit, the control circuit providing a clock pulse signal and a reverse control signal to the data driving circuit and a scanning signal and the reverse control signal to the gate driving circuit, and the panel power supply circuit providing a gate on voltage, the first gate off voltage and the second gate off voltage to the display panel.

13. The method of claim 12, wherein when one of the plurality of gate lines is scanned according to the scanning signal, the gate driving circuit outputs the gate on voltage to the gate line via a corresponding selecting unit, and after the gate line is scanned, the gate driving circuit outputs one of the first gate off voltage and the second gate off voltage stored in corresponding voltage storage units to the gate line via the corresponding selecting unit.

14. The method of claim 13, wherein when the pixel units connected to a gate line corresponding to a scanned voltage storage unit receive the data voltages having the positive polarity, a corresponding voltage storage unit stores the first gate off voltage according to the scanning signal and the reverse control signal, when the pixel units receive the data voltages having the negative polarity, the corresponding scanned voltage storage unit stores the second gate off voltage.

15. The method of claim 13, wherein the plurality of gate lines is successively scanned by the gate driving circuit.

16. The method of claim 13, wherein the plurality of gate lines is alternately scanned by the gate driving circuit.

17. The method of claim 10, wherein adjacent pixel units along an extending direction of the plurality of gate lines are respectively coupled to two adjacent gate lines.

18. The method of claim 9, wherein the difference between the first gate off voltage and the second gate off voltage is substantially equal to the maximal grayscale voltage.

* * * * *